US007121053B2

(12) United States Patent
Toncelli et al.

(10) Patent No.: US 7,121,053 B2
(45) Date of Patent: Oct. 17, 2006

(54) REINFORCED SLAB MADE OF CEMENT CONGLOMERATE, METHOD FOR THE MANUFACTURE THEREOF AND ASSOCIATED REINFORCING STRUCTURE

(76) Inventors: Dario Toncelli, Via San Pancrazio 3 - 36061, Bassano del Grappa (IT); Luca Toncelli, Viale Asiago 34 - 36061, Bassano del Grappa (IT); Maria Luisa Salvalaggio, Via Papa Giovanni XXIII 2 - 36061, Bassano del Grappa (IT)

( * ) Notice: Subject to any disclaimer, the term of this patent is extended or adjusted under 35 U.S.C. 154(b) by 0 days.

(21) Appl. No.: 10/946,612

(22) Filed: Sep. 21, 2004

(65) Prior Publication Data

US 2005/0055985 A1 Mar. 17, 2005

Related U.S. Application Data

(63) Continuation of application No. PCT/EP03/03125, filed on Mar. 26, 2003.

(30) Foreign Application Priority Data

Apr. 4, 2002 (IT) ..... TV2002A0034

(51) Int. Cl.
*E04C 5/01* (2006.01)
*E04C 5/03* (2006.01)
*E04C 5/06* (2006.01)

(52) U.S. Cl. ..... 52/414; 52/649.1; 52/649.8; 52/673

(58) Field of Classification Search ..... 52/414, 52/649.1, 649.8, 650.3, 660, 673, 674, 388, 52/783.17, 443; 264/35
See application file for complete search history.

(56) References Cited

U.S. PATENT DOCUMENTS

| | | | | | |
|---|---|---|---|---|---|
| 536,624 | A | * | 4/1895 | Hayes | 52/674 |
| 887,674 | A | * | 5/1908 | Macintosh | 52/581 |
| 1,576,559 | A | * | 3/1926 | Swift | 52/791.1 |
| 1,726,696 | A | * | 9/1929 | Dean | 52/674 |
| 1,877,964 | A | * | 9/1932 | Purser | 52/674 |
| 1,986,999 | A | * | 1/1935 | Burgess | 52/336 |
| 2,406,559 | A | | 8/1946 | Oakes | |
| 2,934,934 | A | * | 5/1960 | Berliner | 52/601 |
| 3,025,772 | A | * | 3/1962 | Palatini | 404/18 |
| 3,419,457 | A | * | 12/1968 | Bleasdale | 428/124 |
| 4,168,924 | A | * | 9/1979 | Draper et al. | 404/70 |
| 4,640,854 | A | * | 2/1987 | Radtke | 428/34.1 |

(Continued)

FOREIGN PATENT DOCUMENTS

| | | |
|---|---|---|
| AU | 77724/87 | 5/1990 |

(Continued)

*Primary Examiner*—Robert Canfield
(74) *Attorney, Agent, or Firm*—Katten Muchin Rosenman LLP

(57) ABSTRACT

A reinforced slab, in particular able to withstand concentrated loads, has a substantially flat reinforcing structure (20) which is situated at a distance from the bottom (12) of the mould (10) and arranged at a height such as to allow embedding of said reinforcing structure (20) within the end product (40), said reinforcing structure consisting of a sheet oriented substantially parallel to the surfaces of said slab and having a plurality of holes or openings. Preferably said sheet is provided with stiffening ribs and the edges of the holes or openings are folded in the form of a "U". The method for manufacturing the reinforced slab is a method known as "Terastone", except for the step involving insertion, in the forming mould, of the reinforcing structure which is positioned at the desired height by means of support feet.

8 Claims, 4 Drawing Sheets

U.S. PATENT DOCUMENTS

| | | | | | |
|---|---|---|---|---|---|
| 4,923,733 | A | * | 5/1990 | Herbst | 428/156 |
| 5,052,161 | A | * | 10/1991 | Whitacre | 52/385 |
| 5,105,595 | A | * | 4/1992 | Tokei et al. | 52/381 |
| 5,256,007 | A | * | 10/1993 | Allen | 405/302.4 |
| 5,481,843 | A | * | 1/1996 | Kreikemeier | 52/664 |
| 5,489,462 | A | * | 2/1996 | Sieber | 428/174 |
| 5,566,522 | A | * | 10/1996 | .ANG.lander et al. | 52/630 |
| 5,882,453 | A | * | 3/1999 | Stark | 156/70 |
| 6,151,854 | A | * | 11/2000 | Gutjahr | 52/385 |
| 6,355,191 | B1 | | 3/2002 | Toncelli | |
| 6,434,901 | B1 | * | 8/2002 | Schluter | 52/302.1 |
| 6,658,810 | B1 | * | 12/2003 | DeLoach, Sr. | 52/701 |

FOREIGN PATENT DOCUMENTS

| | | | |
|---|---|---|---|
| BE | 431 509 | A | 1/1939 |
| CH | 162 931 | A | 7/1933 |
| DE | 687 484 | C | 1/1940 |
| DE | 818 415 | C | 10/1951 |
| GB | 24555 A. A.D. 1911 | | 0/1912 |
| GB | 320 105 | A | 10/1929 |

* cited by examiner

REINFORCED SLAB MADE OF CEMENT CONGLOMERATE, METHOD FOR THE MANUFACTURE THEREOF AND ASSOCIATED REINFORCING STRUCTURE

This application is the Continuation Under 35 U.S.C. 111(a) of International Application No. PCT/EP03/03125, filed Mar. 26, 2003, which claims the benefit under 35 U.S.C. 119(a–d) of Italian Patent No. TV2002A000034, filed Apr. 4, 2002, which is herein incorporated by reference.

The present invention relates to a reinforced slab made of cement conglomerate, the method for the manufacture thereof and the specific reinforcing structure.

More specifically, the present invention relates to a reinforced slab or panel of cement conglomerate which is able in particular to withstand concentrated loads and is suitable for applications such as, for example, suspended or raised floors, cladding for so-called ventilated walls and the like.

Even more specifically, the present invention relates to slabs of cement conglomerate, of the kind known commercially by the name "Terastone", which are reinforced and able to withstand concentrated loads.

In the description which follows, reference will be made to this type of slab and to a reinforcement thereof intended to make them particularly suitable for concentrated loads, without this having to be regarded as unduly restrictive.

It is known that suspended flooring are widely used for commercial and industrial applications and consist of slabs or panels which are not secured over the whole of their rear side to an underlying base layer, but rest on a perimetral support frame.

In this way an interspace is formed underneath the slabs forming the walking surface which is useful, for example, for laying electrical and telephone lines, ducts for heating and air-conditioning plants, etc.

Unlike conventional floorings, i.e. flooring where each slab or panel rests with the whole of its rear surface on the underlying base layer, in the case of a suspended flooring, the application of a concentrated load, both of the instantaneous type, such as that for example following dropping of a heavy object, and that of the permanent type, in the form of a service load permanently applied to the floor, may cause breakage of the slab with consequences more serious than those which are produced by the same situation involving a conventional floor.

It is obvious that the most critical situations occur in the case of a concentrated load acting in a zone of the slab which is not directly supported, such as the centre or its edge, since in these situations the stresses which are produced in the slabs are of maximum intensity. In particular, the slab is subject to a flexural stress and the concentrated or maximum load applicable in a particular point depends not only on the geometrical properties, but also on the mechanical properties of the material.

The importance of the problem is such that precise standards have been developed, said standards fixing the minimum safety values for withstanding concentrated loads in the case of slabs or panels to be used for suspended floors.

Of these standards, one of the strictest, which guarantees the reliability as regards the desired performance, is the standard UNI 10466 which sets the acceptance requirements of the components to be used for suspended or raised floors.

As regards the maximum breaking load, this standard, in section 10466/7, envisages three classification categories:

| Class | Concentrated load (N) | Concentrated safety load (N) |
|---|---|---|
| 1-light loads | 2000 | 4000 |
| 2-medium loads | 3000 | 6000 |
| 3-heavy loads | 4500 | 9000 |

Above in the present specification reference was made to a particular type of product in the form of a slab or panel (produced and marketed under the name of "Terastone", this name also being used to refer to the associated manufacturing technology). The product "Terastone" is normally made using a known method which comprises the following steps:

a) provision of a granulate of predefined grain size;

b) provision of a cement binder composed of water and cement with a water content of between 0.25 and 0.36 parts by weight referred to the cement weight, with the optional addition of fluidising additives for cement mixtures;

c) preparation of a cement mixture by mixing the granulate with the cement binder;

d) distribution of the cement mixture inside a tray-like mould so as to form a layer of mixture;

e) deaeration of the layer of mixture by means of a very intense vacuum of the order of at least 720 mmHg and for a period of time sufficient to perform a substantially complete deaeration of the mixture;

f) vacuum vibrocompaction of the deaerated layer of mixture by means of application of a vibratory movement with a frequency of 2,000 to 4,800 Hz under a vacuum less intense than that used in step e), but not less than 680 mmHg, and for a duration of at least 60 seconds;

g) hardening and setting of the mixture;

h) extraction from the mould of the end product obtained.

This method, as well as the manufacturing plant and the product thus obtained (referred to below as "Terastone method" and "Terastone slab") are described in detail and claimed in U.S. Pat. No. 6,355,191 in the name of the same Inventor.

This method and the product obtained constitute nowadays a well-established technology which is widespread not only in Italy, but also in many other countries, allowing the manufacture of products in the form of both slabs and tiles which have excellent properties both from a mechanical and in particular from an aesthetic point of view so that the slabs may be used to construct both floors and cladding for internal or external use. The slabs or tiles actually have aesthetic properties which are very similar to those of natural stone, thereby making them extremely attractive. The mechanical properties, if compared with those of natural stone, are also excellent, allowing the products to be used in many fields of application. In particular, the Terastone product has an excellent flexural strength, normally exceeding values of 15 N/mm2. More specifically, a Terastone panel or slab of the known type with dimensions of 60 cm×60 cm×30 mm, resting on its four corners, has a maximum breaking load centred on a particular point of 4651 N, which values falls to 3498 N if the thickness is reduced from 30 to 26 mm.

These values, which are entirely satisfactory for so-called normal uses, are instead unsatisfactory for special applications, such as those mentioned above.

If it is required to produce a Terastone slab which satisfies the requirements laid down in the standards as mentioned above, a preliminary calculation shows that it should have a considerable thickness; for example a slab with dimensions of 60×60 cm for withstanding the Class 3 loads in the abovementioned table should have a thickness of 42 mm. Since the specific weight of the material is about 2.5 kg/dm3, an element with standard dimensions of 60×60 cm (as required by the market) for the construction of suspended floors would have a weight of 36 kg, i.e. a value not only exceeding the limit weight of 27 kg required by the standards and by the market, but also making its usage difficult, even if said usage would be desirable due to the well recognised excellent qualities of the product.

The technical problem which is faced by the present invention, therefore, is that of producing a reinforced Terastone slab having considerable dimensions, preferably 60×60 cm, and a limited thickness, not greater than 25–30 mm, which is in particular able to withstand concentrated loads of at least 9000 N and obviously without altering both the optimum aesthetic and mechanical/physical properties of Terastone slabs.

Another object of the present invention is that of producing a reinforced Terastone slab having the abovementioned properties using the Terastone method, subject to suitable modifications.

Taking into consideration the known art and in particular that relating to so-called reinforced concrete, it could be considered that a solution to the abovementioned technical problem could consist in associating with the Terastone slab a reinforcement consisting of a meshwork of iron material embedded in the thickness of the slab during production.

However, this solution is not technically suitable in the case of thin slabs (thickness not greater than 30 mm), for various reasons and in particular because of the fact that, in order to obtain a reinforcement able to ensure resistance to concentrated loads exceeding the limit value set by the standards, a meshwork formed by round iron rods of a diameter slightly less than the overall thickness of the slab would have to be used. In this case, however, a part of the reinforcement (that adjacent to and above the neutral axis of the slab cross-section) would provide a substantially zero contribution in terms of reinforcement.

Smaller diameters of the round rods which are compatible with the desired thicknesses of the end slab do not attain the values of resistance to the concentrated loads which comply with the abovementioned standards.

Another possible approach for the solution of this technical problem could be based on the technology adopted recently for reinforcing slabs made from granulate of stone materials and/or ceramic materials and a resinous binder (such as for example polyester resin or epoxy resin).

In this case, a reinforcement consisting for example of non-twisted strands of glass or carbon impregnated with a hardening resin is bonded to the rear side of the slab.

This technology, however, in the case of slabs where the binder is cement-based, is not compatible with the operating conditions to which the slab itself is subject, since it is required that the surfaces of the slab, including those for securing to the base layer of the floor or the wall to be clad, should allow moisture to pass through (since it is well-known that cement products, even after laying, continuously absorb and release moisture); if these alternating phenomena do not affect to the same extent the whole of the product, including its surfaces, the product itself may become curved or "warped", with the obvious drawbacks.

In the case of the abovementioned method, reinforcement of the rear surface of the slab with a layer of matting consisting of non-twisted strands of glass or carbon impregnated with a hardening resin would result in an impermeable layer and therefore would prevent the passage of moisture through its surface. The moisture in this case could solely pass from and towards the outside through the non-reinforced side, with the further consequence of a non-uniform behaviour of the finished slab. It is therefore obvious that the known prior art does not offer solutions to the technical problem faced by the present invention.

In the building industry it is known to make generally wide surfaces of concrete mixtures—notably walls, ceilings, floors etc.—reinforced with structures consisting of perforated metal sheets, as shown in the documents DE 818 415 C, BE 431 509A and GB 24 555 A.

It has now been found that this problem, together with others, are solved by the present invention with a reinforced slab, which is in particular able to withstand concentrated loads, of the type formed from a mixture consisting of a granulate of predefined grain size and a cement binder formed by cement and water, which is made in a mould and comprises a substantially flat reinforcing structure provided with holes according to the appended claim 1.

For the manufacture of said reinforced slab, the method according to the present invention is of the type indicated initially, namely envisages the use of a mould, and of substantially flat reinforcing structure provided with holes according to the appended claim 8.

In this way a slab of cement-based material incorporating a reinforcing structure which increases considerably the flexural strength properties of the product is obtained, thereby allowing the use in applications where an optimum resistance to concentrated loads is required, such as suspended floors for example.

The sheet forming the reinforcing structure of the slab according to the present invention must be made of a material which, on the one hand, has a high tensile strength and, on the other hand, is compatible with the cement conglomerate within which it is enclosed.

In the preferred embodiment of the invention, said sheet is made of stainless steel and has a thickness of between 0.6 and 2 mm, preferably about 1 mm.

The sheet as mentioned has a plurality of holes or openings which are distributed uniformly over the surface and perform various functions. Firstly the holes must allow the passage of the cement mixture-which, during step (d) of the method defined above, is poured into the forming mould on top of the said sheet-into the zone underlying the sheet, namely and the zone comprised between the sheet and the bottom of the forming mould which has a thickness smaller than that of the zone located above the said sheet.

For example, in a slab having a thickness of 26 mm, 1 mm of which is occupied by the thickness of the sheet, the remaining 25 mm are divided into about 20 mm situated above the sheet and only 5 mm below the said sheet.

Since the granulate of stone material may comprise a fraction with a grain size of 3–5 mm, it is obvious that the holes or openings formed in the sheet must have a size and be distributed such that the mixture is able to flow into and fill in a continuous and homogeneous manner all of the said zone below the sheet.

Secondly, during the vacuum vibrocompaction step (f), the distribution of the holes or openings in the sheet must allow the free movement of the mixture both between the two zones above and below the sheet and in particular in the zone below the sheet where otherwise partial separation or segregation of the mixture components could occur, to the detriment of the homogeneity required in order to ensure the expected performances of the cement product.

Thirdly, in the end product the conglomerate portions above and below the sheet in the region of the holes or openings of the sheet form a single body. The more frequently and uniformly distributed these portions are (forming a plurality of small columns of conglomerate), the better will be the mechanical properties of the finished slab.

In short, the size and distribution of the holes or openings of the sheet forming the reinforcing structure must be such that the sheet itself does not form a dividing element between two parts of conglomerate which are separate from each other.

In the preferred embodiment of the sheet forming the said reinforcing structure, the holes or openings have folds along their edges, said folds preferably being U-shaped with the concavity of the U directed downwards, namely towards the non-visible side of the finished slab, said folds also forming elements which favour gripping of the cement mixture to the sheet.

Moreover, still within the scope of the said preferred embodiment, the rows of holes or openings formed in the sheet have, formed between them, ribs which are perpendicular to each other and therefore form a proper meshwork, said ribs also being substantially U-shaped with the concavity of the "U" oriented in the same manner as the folded edges of the holes.

These ribs perform the dual function of stiffening the sheet and favouring gripping of the cement mixture to the sheet.

In connection with the various measures mentioned above for favouring gripping of the cement mixture to the sheet, in order to avoid as far as possible relative sliding of the sheet and adjacent cement conglomerate, it is also envisaged manufacturing the sheet with a surface which is rough or roughened, for example by means of sand-blasting. Alternatively, the surfaces of the sheet could be embossed.

Preferably the sheet forming the reinforcing structure is provided with support elements and is placed inside the tray-like mould, before starting the step (d) involving distribution of the mixture, with the support elements resting on the bottom of the tray-like mould so that the structure is situated at a distance from the bottom of the mould; as a result, on account of the holes or openings, during the vibrocompaction step (f), the mixture is uniformly distributed over the entire zone between the bottom of the tray-like mould and said reinforcing structure.

With this particular measure no unnecessary complications are introduced into the method, and therefore the already existing production plants, since it possible to envisage a further step during which the reinforcing structure is introduced before starting the mixture distribution step, by simply resting it on the bottom of the tray-like mould, at a suitable distance therefrom.

Finally, by way of a preferred embodiment, the reinforcing structure, in addition to the support elements projecting perpendicularly with respect to the bottom surface of the sheet, has laterally projecting elements which are intended to rest against the adjacent walls of the mould or on top of the perimetral edges of the mould, with the result that the reinforcing structure is automatically centred with respect to the mould.

These and many other innovative features of the present invention will emerge more clearly from the following detailed description of an embodiment, which is provided as a non-limiting example, with reference to the accompanying drawings in which.

Figure 1:
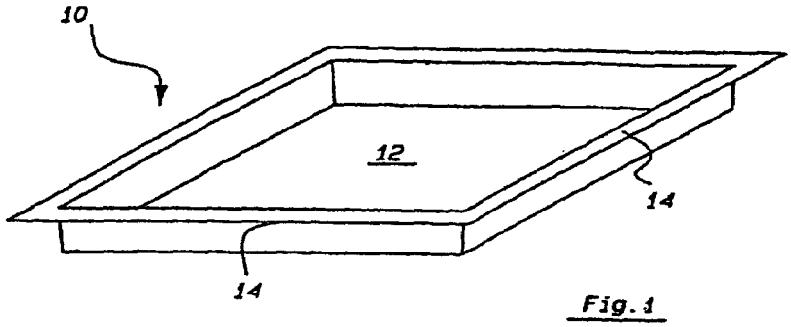
FIG. 1 is a perspective view of a tray-like mould.

FIG. 1 shows a tray-like mould 10 which comprises a bottom 12 and a peripheral edge 14 for retaining the mixture which will be poured, i.e. distributed inside it.

Figure 2:
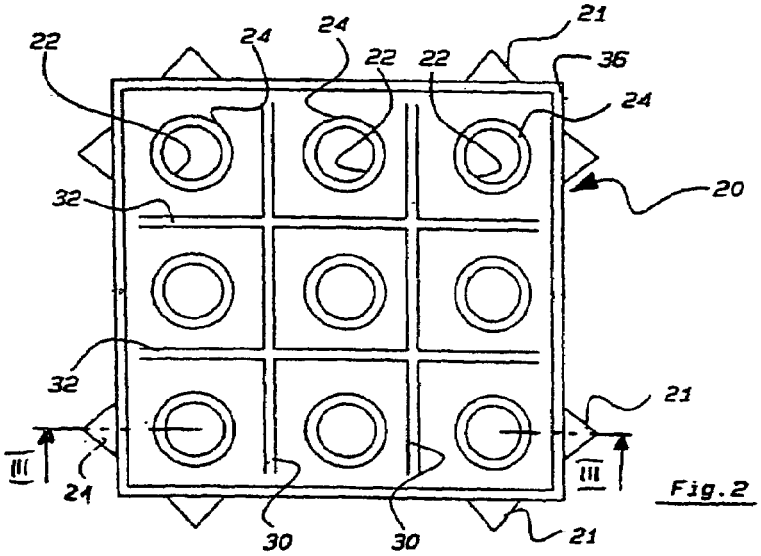
FIG. 2 is a top plan view of a reinforcing structure according to the invention.
Figure 3:
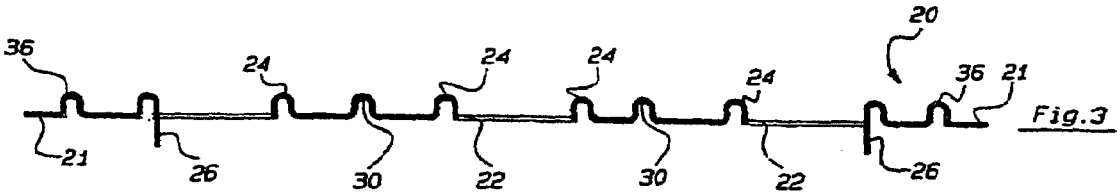
FIG. 3 is a cross-sectional view of the reinforcing structure along the line III—III of FIG. 2.

A reinforcing structure 20, which is shown in FIGS. 2 and 3, is placed inside the tray-like mould 10, said structure consisting of a thin perforated sheet made of corrosion-resistant material, preferably stainless steel, of substantially the same size as the tray 10, or preferably slightly smaller. The reinforcing structure or sheet 20 is provided with holes 22 arranged in rows and at the same distance from each other so as to form a chequered arrangement.

In the embodiment illustrated, the peripheral edge 24 of the holes 22 is folded so as form a "U" with the concavity directed downwards when the sheet 20 is placed on the bottom 12 of the tray-like mould 10. In addition, feet 26 are provided, for example at least at the four corners of the sheet 20 and optionally in the centre thereof, said feet forming support elements on which the sheet 20 rests when it is placed on the bottom 12 of the mould 20, so as to be situated at a distance from the bottom 12 equal to the height of the feet 26.

The formation of the holes 22 with the peripheral edge 24 folded in the form of a "U" and of the feet 26 may be performed in any known manner by means of a combined operation involving punching and drawing.

Moreover, the sheet 20 may be provided with lateral projections, such as those indicated by the reference number 21, which have the function of centring the sheet 20 with respect to the perimetral edges of the mould or tray 10. These projections 21 may be easily formed by means of punching and drawing at the same time as the holes 22 with the folded edges 24 and the feet 26.

The sheet 20 may also be provided with longitudinal ribs 30 and transverse ribs 32 consisting of folds in the form of a "U" with the concavity directed downwards. The stiffening ribs 30 and 32 are arranged perpendicularly with respect to each other so as to ensure that the structure 20 has the maximum rigidity.

Finally, the sheet 20 may have a perimetral edge 36 folded over so as to form a "U" with the concavity directed downwards.

Both the stiffening ribs 30,32 and the folded perimetral edge 36 have the primary function of ensuring a better adhesion between the sheet 20 and the surrounding cement conglomerate, as well as ensuring a greater resistance of the entire sheet to flexural stresses.

As already mentioned above, the sheet 20 is placed inside the tray 10 before pouring of the cement mixture so that the feet 26 rest on the bottom 12 of the mould 10.

During distribution of the mixture (step d) only a small amount passes through the holes 22 so as to reach the bottom 12 of the tray-like mould 10. Only at a later stage, during the vibrocompaction step (step f), does a part of the mixture previously poured into the mould 10 pass through the holes 22 and fill entirely the existing zone between the bottom 12 of the mould 10 and the sheet 20.

It should be noted that, since the peripheral edges 24 of the holes 22, the stiffening ribs 30,32 and the perimetral edge 36 do not project below the sheet 20, the complete distribution of the mixture in the underlying zone is not hindered in any way.

Figure 4:
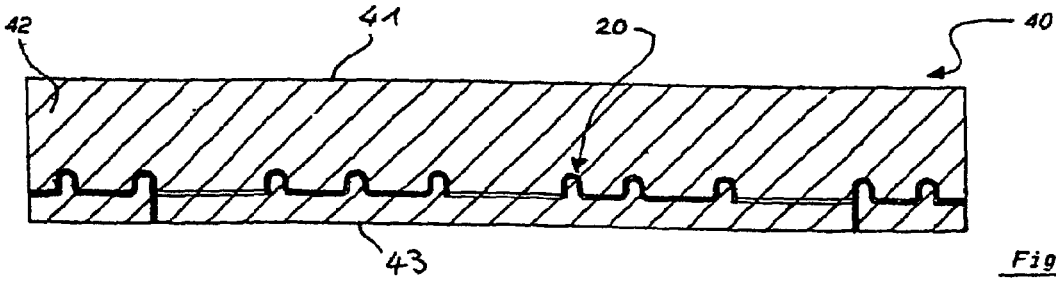
FIG. 4 is a cross-sectional view of a product in the form of a slab manufactured according to the present invention.
Figure 5:
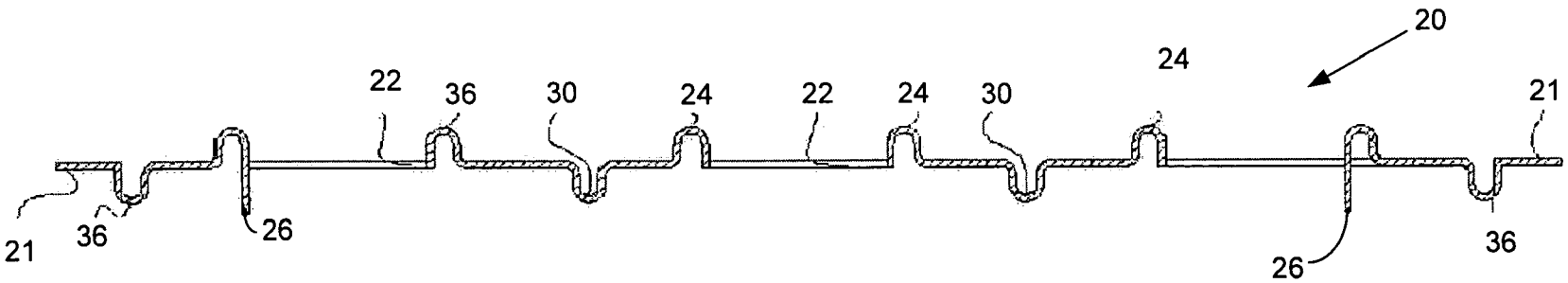
Figure 6:
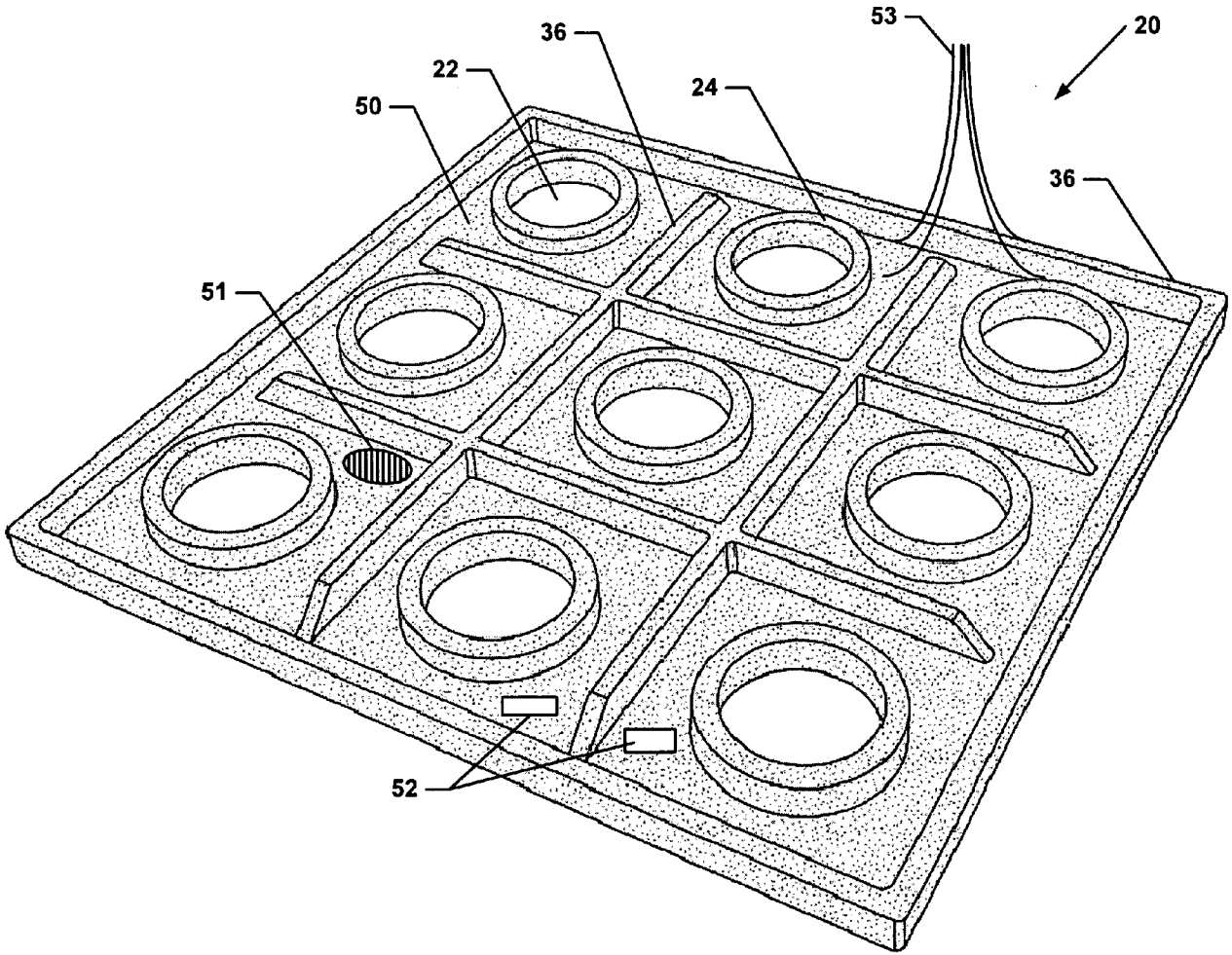
Figure 7:
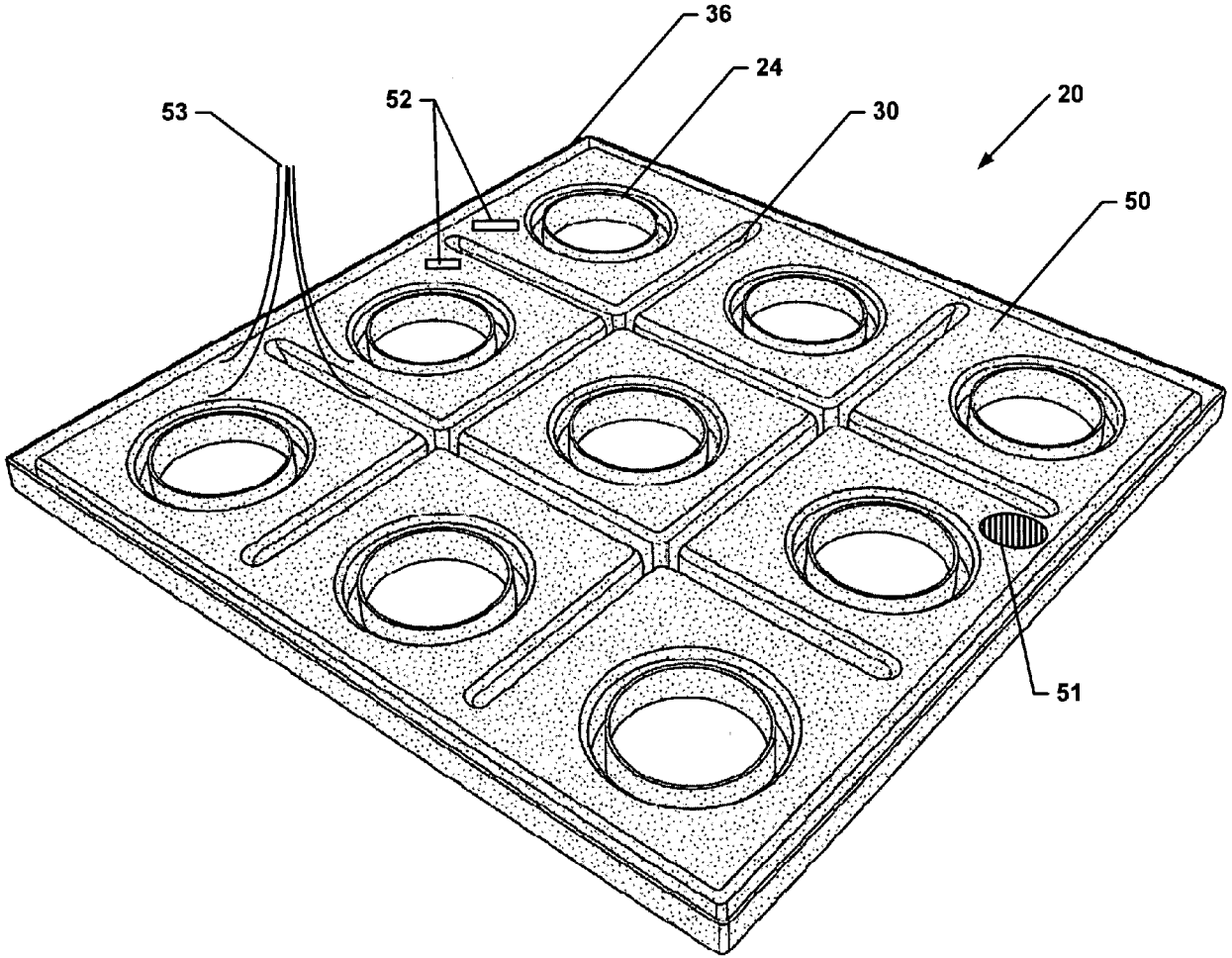

Subsequent to the hardening and setting step (g), the sheet 20 is entirely embedded in the cement product, as can be noted from FIG. 4 which shows an manufactured article 40 composed of a cement mixture 42, inside which the sheet 20 is incorporated. The slab 40 has an upper and a lower surface 41 and 43 which are parallel and constitute the main surfaces of the slab.

It should be noted, in addition, that the holes 22 do not perform only the function of allowing the free passage of the mixture during the vibrocompaction step (f), but also have the function of ensuring a physical continuity between the portion of the cement mixture 42 lying below the structure or sheet 20 and the portion lying above it.

From FIG. 2 it can be easily understood how, with the perforated sheet 20 according to the present invention, it is ensured that within the body of the slab there is a considerable surface area of steel which could not be achieved with other types of reinforcement and in particular with a meshwork consisting of round metal rod.

For example, in the case of a sheet 20 having a size of 60×60 cm and provided with 81 holes of 32 mm diameter, the reinforcement is ensured by 295,000 mm2 of steel while 65,000 mm2 of openings ensure a free communication between the two zones respectively above and below the same sheet.

To summarise, the discontinuity created by the sheet 20 is substantially eliminated and the end product 40, although it is composed of various elements, acts as though it were a single element. In order to facilitate the adhesion of the layer of cement mixture onto the sheet 20, both the surfaces of the sheet 20 may be rough or in any case be roughened, for example by means of sandblasting. Alternatively, it is possible to perform embossing of the surface of the sheet 20.

Basically a composite product is obtained, consisting of a cement mixture 42 combined with a reinforcing structure 20 which improves significantly the flexural strength characteristics with no substantial increase in the weight of the product.

The function of the reinforcing structure is solely that of reinforcing the product, while the cement mixture has the function of also contributing to the overall strength of the end product.

Let us now consider the fact that, in suspended floors (owing to the loads acting thereon), the bottom part is subject to tensile stresses, while the top part is subject to compressive stresses. Then, also the reinforcing structure is subject to tensile stresses, but since steel has a high maximum tensile strength, it allows a considerable increase of the strength of the product. On the other hand, the upper part of the cement mixture is subject to compression, but cement materials have optimum compressive strength characteristics (approx. 100 N/mm2), as it is well known. It is therefore possible to exploit in the best manner possible both the mechanical characteristics of the reinforcing structure and those of the cement mixture.

If the upper surface is the surface which, after being sized and smoothed, is intended to become the visible surface of the product, the sheet 20 must be positioned securely underneath the neutral axis of the vertical cross-section of the sheet in order to perform at its best a reinforcing function, preferably as close as possible to the bottom 12 of the mould 10, even if at a sufficient distance to be perfectly incorporated within the cement mixture 42. Basically, in the specific case of slabs of 60×60 cm with an overall thickness of 27 mm (including a structure or sheet 20 of 1 mm thickness) which are formed by a cement mixture where the aggregate has a grain size ranging from 0.1 to 3 and up to 5 mm, the height of the feet 26, to which the thickness of the cement mixture 42 situated below the structure or plate 20 corresponds, must have a suitable value of between 4 and 8 mm (as it has been determined). The overall weight of such a product ranges between 25 and 26 kg.

It is worth noting that, in relation to the standard UNI 10466 mentioned above, it has been found that a slab or panel made in accordance with the present invention possesses a significantly higher maximum breaking load at any given point.

In fact, in the case of a Terastone slab with dimensions of 600×600×26 mm, the normal maximum breaking load of which was 3498 N, following insertion of the perforated reinforcing sheet, the maximum breaking load increases to a value of 16240 N which makes the sheet or panel utilisable also with permanent heavy loads.

The present invention has been described in connection with Terastone slabs for suspended flooring, but it is understood that the invention may also be advantageously applied to Terastone slabs or panels for other applications such as, for example, cladding of walls of the so-called ventilated type. In this case the reinforcing structure also ensures a so-called "anti-collapse" function, namely in the event of breakage the fragments of the slab are retained in position by the reinforcing sheet, with obvious advantages.

It is understood that functionally equivalent modifications and variants fall within the scope of the present invention. For example it is possible to provide holes having a different shape, such as a square shape, or the peripheral edges of the holes or the perimetral edge of the reinforcing structure may be folded in a different manner.

The invention claimed is:

1. A reinforced slab made in a mould, the reinforced slab comprising:

a mixture formed of a granulate of a predefined grain size and a cement binder formed of cement and water, the mixture formed into a layer comprising substantially no entrained air and having a flexural strength of at least 15 N/1 $mm^2$;

an upper and a lower main surface, the main surfaces being substantially flat and parallel to one another;

a reinforcing structure consisting of a sheet of a metal provided with a plurality of holes so as to allow the free passage of the mixture, the sheet being entirely embedded in the body of the reinforced slab and being arranged substantially parallel to the main surfaces thereof, the sheet comprising a plurality of feet to space the sheet from the mould, lateral projections for centering the sheet with respect to a peripheral edge of the mould;

wherein the sheet is arranged at a given distance from the neutral axis of the associated cross-section.

2. The reinforced slab according to claim 1 wherein said holes of the sheet form a checkered arrangement and have a peripheral edge which is folded so as to form a 'U' with the concavity directed towards the surface of the slab opposite to the surface intended to remain visible on the end product.

3. The reinforced slab according to claim 1, wherein said sheet is provided with two series of ribs which are perpendicular to each other and in the form of folds shaped as a "U" with the concavity directed towards one of the upper and lower surface of the slab opposite to the one of the upper and lower surface intended to remain visible on the end product, the said ribs performing the dual function of stiffening the sheet and favouring gripping the cement mixture to the sheet.

4. The reinforced slab according to claim 1 wherein said sheet comprises a perimetral edge, from which the said lateral projections are protruding, which is folded over so as to form a "U" with the concavity directed towards one of the upper and lower surface of the slab opposite to the one of the upper and lower surface intended to remain visible on the end product.

5. The reinforced slab according to claim 1 wherein said sheet is provided with means for securing the cement mixture, the said means comprising one of rough or roughened portions of its surfaces which come into contact with said mixture embossed areas of said surfaces.

6. The reinforced slab according to claim 1 wherein said sheet is made of stainless steel.

7. The reinforced slab according to claim 6, wherein said sheet has a thickness of between 0.5 and 2.0 mm.

8. A reinforced slab made in a mould, the reinforced slab comprising:

a layer made of a mixture formed of a granulate of a predefined grain size and a cement binder formed of cement and water, the layer comprising substantially no entrained air and having a specific weight of at least 2.45 kg/dm$^3$ achieved by vibrocompaction;

an upper and a lower main surface, the main surfaces being substantially flat and parallel to one another, a reinforcing structure consisting of a sheet of a provided with a plurality of holes so as to allow the free passage of the mixture, the sheet being entirely embedded in the body of the reinforced slab and being arranged substantially parallel to the main surfaces thereof, the sheet comprising a plurality of feet to space the sheet from the mould, lateral projections for centering the sheet with respect to a peripheral edge of the mould;

wherein the sheet is arranged at a given distance from the neutral axis of the associated cross-section.

* * * * *